US006039403A

United States Patent [19]

Hargroder

[11] Patent Number: 6,039,403

[45] Date of Patent: Mar. 21, 2000

[54] SHOWER/TUB TRANSFER CHAIR

[76] Inventor: Todd Hargroder, 7626 Grissom Rd., San Antonio, Tex. 78251

[21] Appl. No.: 09/061,767

[22] Filed: Apr. 16, 1998

[51] Int. Cl.[7] ..... A47C 7/00

[52] U.S. Cl. ..... 297/440.24; 297/440.16; 297/452.2; 4/578.1

[58] Field of Search ..... 297/440.16, 440.24, 297/440.21, 452.2, 440.1, 16.1; 5/546, 559, 560.1, 571.1; 4/560.1, 571.1, 578.1

[56] References Cited

U.S. PATENT DOCUMENTS

| | | | |
|---|---|---|---|
| 570,208 | 10/1896 | Harry | 297/440.16 X |
| 3,990,745 | 11/1976 | Rodaway | 297/440.16 |
| 4,253,203 | 3/1981 | Thomas | 4/559 |
| 4,359,791 | 11/1982 | Thomas | 4/546 |
| 4,391,006 | 7/1983 | Smith | 4/559 |
| 5,068,930 | 12/1991 | Ruggiero | 4/560 |
| 5,185,892 | 2/1993 | Mitchell | 4/578.1 |
| 5,606,751 | 3/1997 | Baker | 4/560.1 |
| 5,649,742 | 7/1997 | Liu | 297/440.24 X |

FOREIGN PATENT DOCUMENTS

| | | | |
|---|---|---|---|
| 241628 | 10/1987 | European Pat. Off. | 297/440.16 |

OTHER PUBLICATIONS

1992 INVACARE Product Brochure, Form No. 88–57, Revised Sep. 1993.

*Primary Examiner*—Milton Nelson, Jr.
*Attorney, Agent, or Firm*—Kammer & Huff, PLLC

[57] ABSTRACT

An improved shower/bathtub transfer chair that is capable of disassembly into five basic components. The chair seat and back structures, separable from each other and from the support frame for the device, serve as two of the five components. The remaining three components include an inside leg frame component, an outside leg frame component, and a cross frame component. When disassembled through the use of locking pin mechanisms, each of the five components described provide a generally planar geometry that can be stacked and arranged within a rectangular, suitcase-styled enclosure, for transport and/or storage.

1 Claim, 5 Drawing Sheets

SHOWER/TUB TRANSFER CHAIR

BACKGROUND OF THE INVENTION

1. Field of the Invention

The present invention relates generally to improvements in a transfer chair that is used to assist persons entering and exiting a bathtub or shower stall. More specifically, the improvements of the present invention involve a transfer bench that is collapsible into a suitcase-sized configuration for easy transportation in vehicles, airplanes and the like while maintaining its durable support when in use.

2. Description of the Related Art

A variety of devices have been developed to assist persons with the process of safely entering and exiting shower stalls and bathtubs for cleansing and personal hygiene purposes. These devices have been designed to provide not only safe movement in and out of the bathtub or shower but to additionally provide comfort and stability during use. One such line of products is marketed by Invacare Corporation of Elyria, Ohio. The Invacare® devices provide sturdy and comfortable transfer chairs for both showers and baths. The basic device provides a comfortable transfer over a bathtub wall utilizing an aluminum frame with flared legs for stability. A side arm is provided on one end of the transfer chair for safety and padded seat and back supports provide comfort. The basic device has vertically adjustable legs with suction grips and rubber tips where contact is made with the tub or shower floor.

Much of the focus of earlier designs, as typified by the Invacare® device described above, has been on the combination of comfort and stability. While the prior art devices are typically capable of disassembly, such disassembly involves the removal of various nuts and bolts and clips that are intended to maintain a semi-permanent structural integrity to the device. In other words, the designs do not lend themselves to rapid and easy collapsibility for transport and the like.

Various efforts have been made to design folding transfer benches and transfer chairs for the purpose of easily removing the device from the bathtub or shower stall or for otherwise storing the device in a flattened configuration. The following patents provide examples of some efforts in the past to create collapsible benches and transfer chairs.

U.S. Pat. No. 4,253,203 issued to Thomas on Mar. 3, 1981, entitled "Folding Transfer Bench" describes a complicated assembly of rails and folding legs that permit the movement of a chair on rollers across the length of the transfer bench. Removable pins secure the longitudinal rails of the device to folding leg supports that are hingedly attached to the longitudinal rails. The legs fold in to reduce the overall height of the device but do not reduce either the height of the seat or the length of the device when collapsed.

U.S. Pat. No. 4,359,791 issued to Thomas on Nov. 23, 1982, entitled "Folding Transfer Bench With Improved Roller and Arm Assembly" describes a device similar to the above-referenced Thomas device with a simplified chair structure that again rolls across longitudinal rails. No improvement is made to the collapsible features associated with the device, other than the simpler removal of the chair from the rail structure.

U.S. Pat. No. 4,391,006 issued to Smith on Jul. 5, 1983, entitled "Transfer Bench" describes a bathtub or shower stall bench/chair that, although capable of disassembly, involves a large number of bolts, wing nuts, and other attachment means designed to maintain the rigidity of the structural frame that the bench is based on. While the device collapses into a relatively compact structure, it does so only at the expense of complex attachment mechanisms that are both difficult to assemble and disassemble, and require the storage of a large number of small parts. In addition, the seat structure of the Smith design does not lend itself to a reduction in size for storage or transport.

U.S. Pat. No. 5,068,930 issued to Ruggiero on Dec. 3, 1991, entitled "Invalid's Bathtub Seat" describes a design with legs that are intended to fit fully within the bathtub structure and rails that extend partially over the edge of the tub. The complicated seat design permits movement in and out of the tub on a rail and roller construction.

U.S. Pat. No. 5,185,892 issued to Mitchell on Feb. 16, 1993, entitled "Tub and Shower Seat" describes a simple collapsible seat that is intended to be permanently mounted within the shower stall or bathtub enclosure. While capable of collapsing into a flat configuration against the wall of the shower stall or bathtub, it sacrifices portability for the sake of stability within the enclosure.

U.S. Pat. No. 5,606,751 issued to Baker on Mar. 4, 1997, entitled "Shower Chair and Bathtub Transfer Assembly" describes a collapsible structure that forgoes the use of legs in favor of a press fit wall attachment mechanism. While the structure does collapse to reduce the height of the overall device, the length of the rails and support sections do not collapse or come apart.

It would be desirable to have a collapsible shower or tub transfer chair that continued to provide both the stability and comfort of designs developed in the prior art, but additionally provided mechanisms whereby the device could be collapsed, disassembled, or folded into a configuration that could fit within standard suitcase-sized enclosures for the purposes of transport and/or storage. It would be desirable if the process of disassembling the device was simple, straightforward, and required little or no use of attachment mechanisms that could be lost or otherwise misplaced during repeated assembly and disassembly.

SUMMARY OF THE INVENTION

It is, therefore, an object of the present invention to provide an improved transfer bench for use in bathtubs and/or shower stalls that provides not only safety, comfort, and stability for persons entering and exiting the bathtub or shower stall through use of the device, but additionally provides mechanisms for easy collapsibility for the purposes of storage and/or transport of the device.

It is a further object of the present invention to provide a collapsible shower/tub transfer chair that uses few if any loose parts in the assembly or disassembly process.

It is a further object of the present invention to provide a collapsible shower/tub transfer chair that is easily disassembled into a small number of component sections.

It is a further object of the present invention to provide a collapsible shower/tub transfer chair that does not sacrifice stability and rigidity when assembled for its collapsible features.

It is a further object of the present invention to provide a collapsible shower/tub transfer chair that can be reduced in size when disassembled to a point where the components of the device may fit easily within the confines of a typical suitcase-styled enclosure for the purpose of transport within vehicles, airplanes and the like.

In fulfillment of these and other objectives, the present invention provides an improved shower/bathtub transfer chair that is capable of disassembly into five basic components. The chair seat and back structures, separable from each other and from the support frame for the device, serve as two of the five components. The remaining three components include an inside leg frame component, an outside leg frame component, and a cross frame component. When disassembled through the use of locking pin mechanisms, each of the five components described provides a generally planar geometry that can be stacked and arranged within a rectangular, suitcase-styled enclosure, for transport and/or storage.

DESCRIPTION OF THE PREFERRED EMBODIMENT

Figure 1:
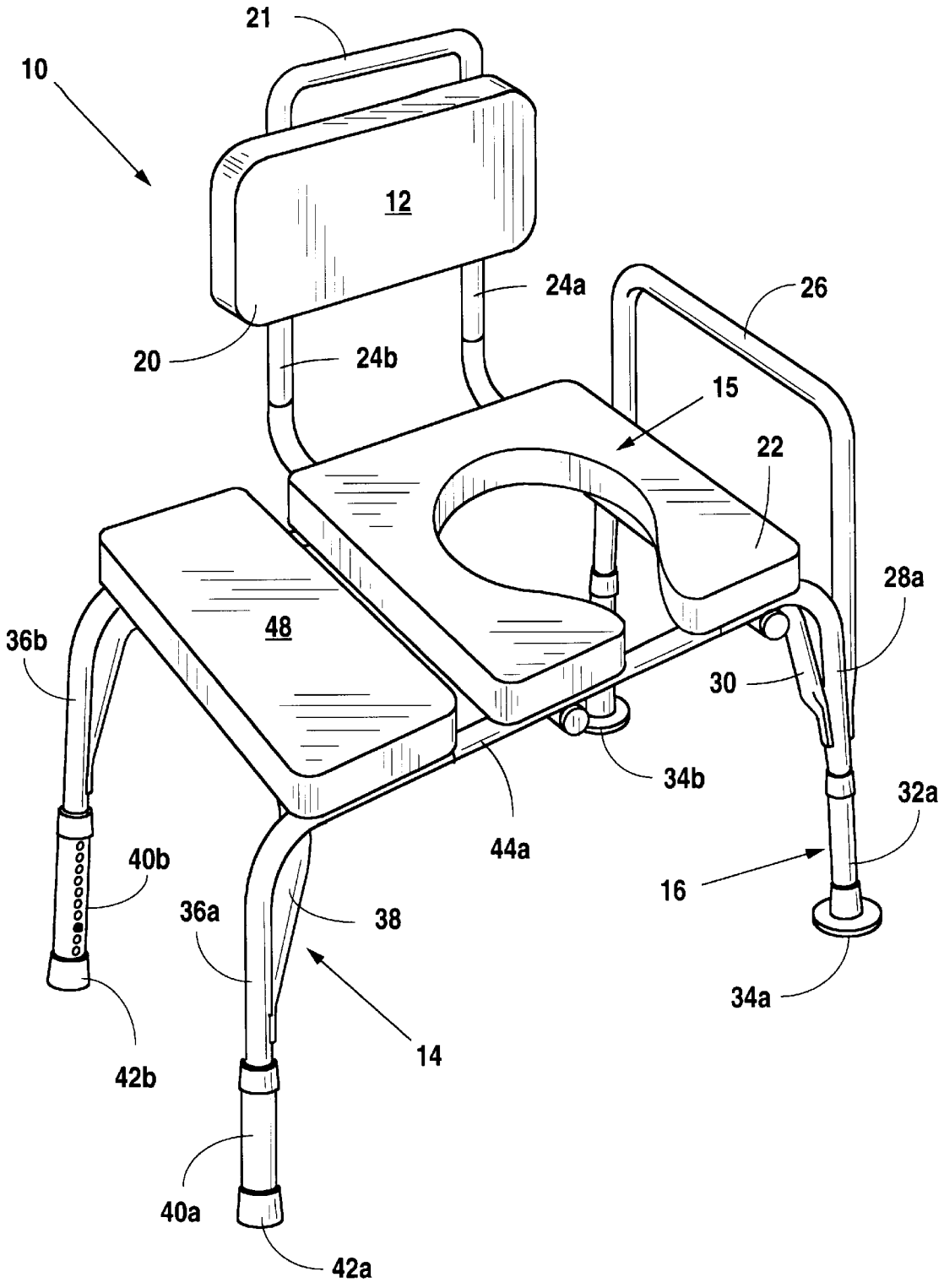
FIG. 1 is a perspective view of the assembled transfer chair of the present invention.

Reference is made first to FIG. 1 for a general description of the structure and function of the shower/bath transfer chair of the present invention. Transfer chair (10) is primarily comprised of chair back section (12), chair seat section (15), and outside leg frame section (14), inside leg frame section (16), and a pair of connecting cross frame sections (44*a*) and (44*b*). These primary components, when assembled as described in more detail below, provide a safe, comfortable, and stable means for persons to transfer in and out of bathtub or shower stall enclosures.

Chair back section (12) is comprised primarily of back cushion (20), top frame (21) and support posts (24*a*) and (24*b*). Chair back section (12) is attached to chair seat section (15) as described in more detail below. The combination of chair back section (12) and chair seat section (15), is attached to and supported by the combination of the three remaining primary components of the present invention.

Outside leg frame section (14) and inside leg frame section (16) are connected to each other by way of cross frame sections (44*a*) and (44*b*). These components, when connected together, provide a four-legged framed support structure designed to receive and retain the combination of chair back section (12) and chair seat section (15).

Outside leg frame section (14) comprises a pair of leg frame members (36*a*) and (36*b*) which are connected together by way of U-frame section (38). Leg frame members (36*a*) and (36*b*) telescope in and out of leg base sections (40*a*) and (40*b*) which are each capped with soft rubber caps (42*a*) and (42*b*). Inside leg frame section (16) is configured similarly to outside leg frame section (14). Leg frame members (28*a*) and (28*b*) are connected to each other by way of U-frame section (30) This structure telescopes in and out of leg base sections (32*a*) and (32*b*) which are each capped with suction cup caps (34*a*) and (34*b*). Side arm (26) extends up from leg frame members (28*a*) and (28*b*) to provide a handle support to assist with movement across the transfer chair.

When assembled by way of connecting cross frame sections (44*a*) and (44*b*) between leg sections (14) and (16) as described, a chair platform consisting of seat cushion (22) and transfer cushion (48) is provided for the user.

Figure 2:
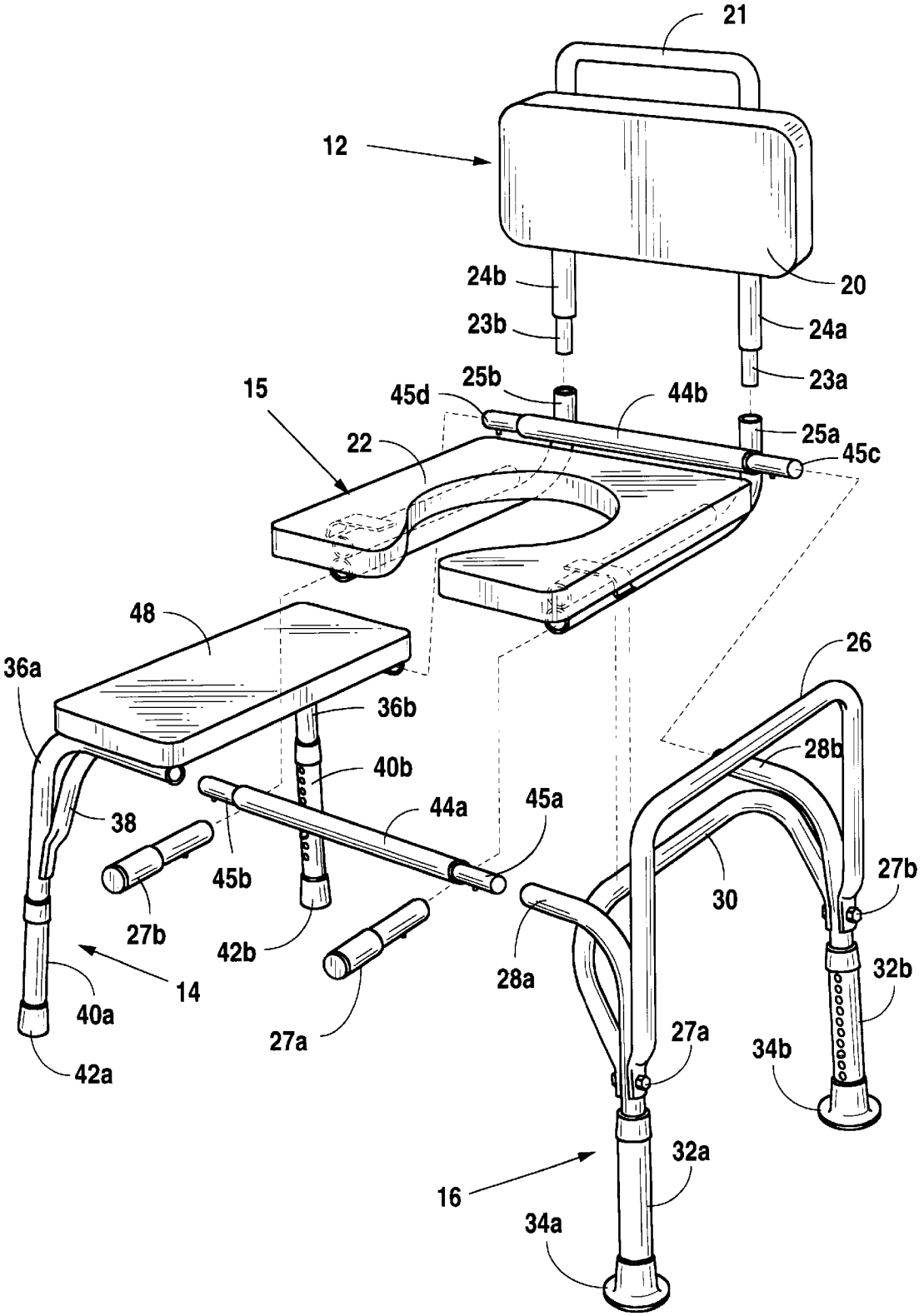
FIG. 2 is an exploded perspective view of the transfer chair of the present invention.

Reference is now made to FIG. 2 for a detailed description of the mechanisms whereby the structure of the present invention can be disassembled and/or collapsed into a more compact configuration. As indicated above, chair back section (12) consists primarily of back cushion (20), top frame (21), and support posts (24*a*) and (24*b*). In FIG. 2 the mechanisms for attaching chair back section (12) to chair seat section (15) are disclosed as locking inserts (23*a*) and (23*b*). The locking inserts described at this position on the device, and in other similar positions on the device, are tightly insertable within the open tubular frame structures of the transfer chair. These attachment mechanisms generally consist of a section of tubing having a diameter slightly smaller than the tubular frame members. One end of each attachment mechanism is permanently fixed within a first frame section while the second end of the attachment mechanism is free to be inserted and/or removed from a second section of frame. Connection to the second section of frame is generally made through a locking pin structure as is well known in the art. Such locking pin structures are operated by pushing a spring-loaded pin down into the tubular structure of the attachment mechanism and out of the way so that the attachment mechanism can be inserted into the second frame structure. Once the attachment mechanism is positioned within the inside diameter of the second tubular frame section, the spring-loaded pin finds a matching aperture on the wall of the second frame section that it pops into in order to lock the attachment mechanism into place. Removal of the attachment mechanism involves forcing the spring-loaded pin back through the aperture in the tubular frame member and the slidable removal of the attachment mechanism from the second frame section.

It is understood that the attachment mechanisms described here, (23*a*) and (23*b*), in conjunction with the seat back of the present invention are similar in all respects to the other attachment mechanisms described throughout the device.

Returning again to FIG. 2, chair seat section (15) is shown comprised of seat cushion (22) and seat support members (25*a*) and (25*b*). As indicated in FIG. 2, seat support members (25*a*) and (25*b*) are attached to chair back support posts (24*a*) and (24*b*) by means of attachment mechanisms (23*a*) and (23*b*).

The support frame for the transfer chair includes outside leg frame section (14) and inside leg frame section (16), which as described above, are connected to each other by way of cross frame sections (44*a*) and (44*b*). Cross frame section (44*a*) incorporates attachment mechanisms (45*a*) and (45*b*), while cross frame section (44*b*) includes attachment mechanisms (45*c*) and (45*d*).

Outside leg frame section (14) comprises leg frame members (36*a*) and (36*b*), which are slidably insertable into leg base sections (40*a*) and (40*b*) which are capped by rubber caps (42*a*) and (42*b*). Leg frame members (36*a*) and (36*b*) are connected one to another by way of U-frame section (38). Covering and attached to both leg frame members (36*a*) and (36*b*), as well as U-frame section (38), is transfer cushion (48).

Inside leg frame section (16) is likewise comprised of leg frame members (28*a*) and (28*b*) which are connected to each other by way of U-frame section (30) as well as by side arm (26). Bolted attachment means (27*a*) and (27*b*) secure both U-frame section (30) and side arm (26) to leg frame members (28*a*) and (28*b*). Leg base sections (32*a*) and (32*b*) slide over the ends of leg frame members (28*a*) and (28*b*) in telescoping fashion to provide adjustability to the overall height of the chair. Each of leg base sections (32*a*) and (32*b*) are capped with suction cups (34*a*) and (34*b*) for secure attachment to a bathtub or shower floor surface.

After outside leg frame section (14) has been attached to inside leg frame section (16) by way of cross frame sections (44*a*) and (44*b*), the combination of chair back section (12) and chair seat section (15) can be mounted to the leg frame structure. Placed generally as shown in FIG. 2, the front of chair seat section (15) rests on top of cross frame section (44*a*) and the back of chair seat section (15) captures cross frame section (44*b*) between seat cushion (22) and seat support members (25*a*) and (25*b*).

Once the combination of chair back section (12) and chair seat section (15) are placed in position on the support frame, attachment mechanisms (27*a*) and (27*b*) are inserted into seat support members (25*a*) and (25*b*) on chair seat section (15), in a manner that holds chair seat section (15) captively around cross frame section (44*a*). In this manner chair seat section (15) and chair back section (12) will resist any movement backwards or forwards across the leg frame support structure.

It is recognized that part of the original design for the transfer chair described permitted the left-handed or right-handed orientation of the seat section with respect to the transfer section. In both the design of the preferred embodiment and the alternative embodiment described above, the ability to modify the position of the chair section to either a left-handed or right-handed configuration remains.

Figure 3:
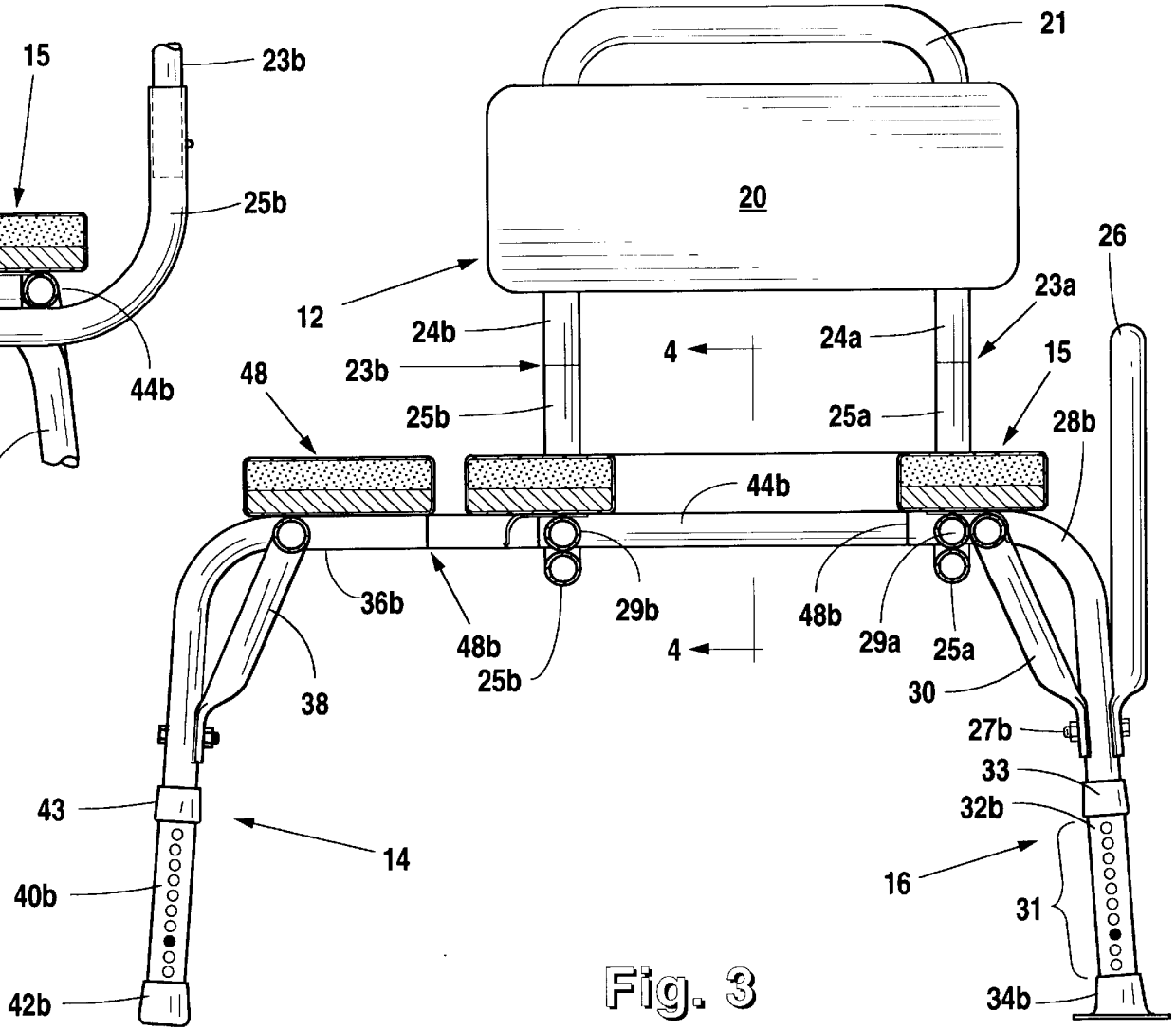
FIG. 3 is a longitudinal cross section view of the transfer chair.
Figure 4:
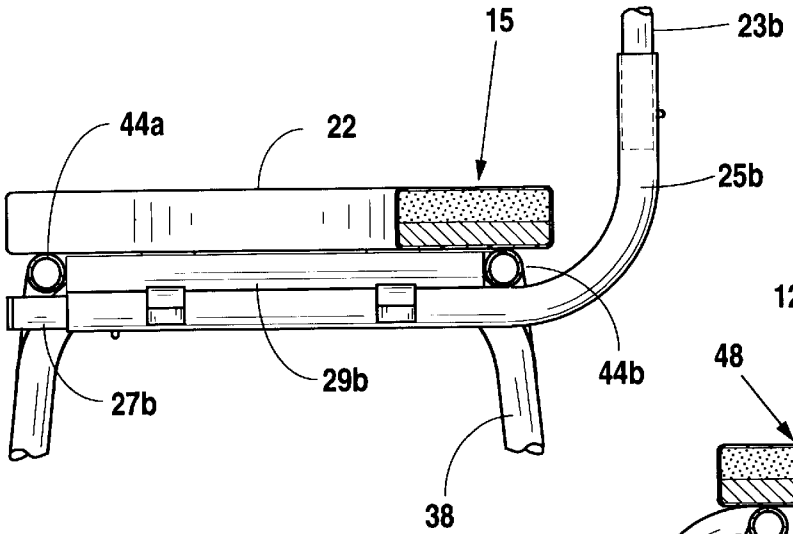
FIG. 4 is a cross section view taken on the line 4—4 of FIG. 3.

Reference is now made to FIGS. 3 and 4 for a detailed description of the assembled construction of the present invention. FIG. 3 is a cross-sectional, detailed view taken longitudinally across the transfer chair of the present invention. In this view the relative dimensions of the various components of the transfer chair are disclosed. The overall length of the transfer chair is divided among outside leg frame section (14), cross frame section (44*b*), and inside leg frame section (16). Connecting joints (48*a*) and (48*b*) are disclosed in FIG. 3. Similar connecting joints (not shown) are associated with cross frame section (44*a*).

In addition, FIG. 3 discloses the relative position of connecting joints (23*a*) and (23*b*) between chair back section (12) and chair seat section (15). In this view the geometry of the collapsed components of the present invention can be anticipated. The longest component section is the inside leg frame section. All of the various sections when disassembled have basically the same width, namely the overall width of the transfer chair from front to back. Finally, the component with the deepest profile (the greatest height in a collapsed configuration) ends up being the outside leg frame section, having a depth basically that of the width of transfer cushion (48).

FIG. 4 shows in cross-sectional detail the mechanism whereby the chair structures are attached to the leg frame structures and are held captive around cross frame sections (44*a*) and (44*b*). As described above, the front of chair seat section (15) rests on top of cross frame section (44*a*) and the back of chair seat section (15) captures cross frame section (44*b*) between seat cushion (22) and seat support members (25*a*) and (25*b*). Attachment mechanisms (27*a*) and (27*b*) are inserted into seat support members (25*a*) and (25*b*) in order to hold chair seat section (15) captive around cross frame section (44*a*). Spacer section (29*b*) disclosed in FIG. 4 separates and positions seat cushion (22) apart from seat support members (25*a*) and (25*b*) in order to provide the space for cross frame sections (44*a*) and (44*b*).

Figure 5:
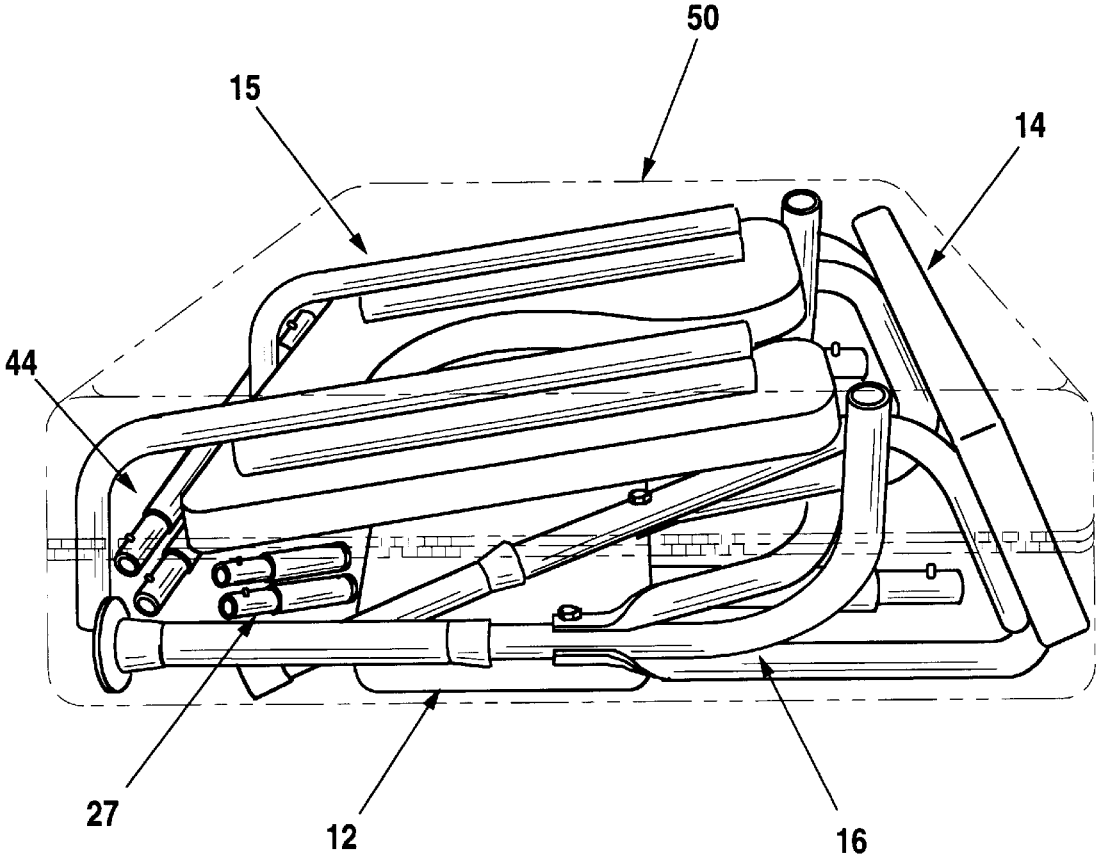
FIG. 5 is a perspective view of a collapsed transfer chair as positioned within a suitcase for transport.

Reference is now made to FIG. 5 for a brief description of the device of the present invention in a disassembled configuration suitable for storage within a rectangular structure such as a standard sized suitcase enclosure. Arranged and layered as shown in FIG. 5 are chair back section (12) overlaid with inside leg frame section (16) and outside leg frame section (14). On top of these, and positioned as shown, is chair seat section (15). The remaining components, cross frame sections (44) and attachment mechanisms (27), are placed as convenient around the layered frame and chair components.

When layered and arranged in the disassembled configuration shown in FIG. 5, these components fit easily within the confines of a standard suitcase sized structure (50), on the order of forty inches by thirty inches by twelve inches.

Critical to the collapsibility and compactness of the improvements of the present invention is the separation of the inside leg frame section from the outside leg frame section in the support frame structure. When this separation is made at the two points shown in the longitudinal cross frame sections of the leg frame structure, the resulting components are planar or nearly planar in profile.

A similar separation of the right angled structure of the prior art associated with the chair back and seat sections also provides two relatively planar components that can be layered and placed against the leg frame sections for storage or transport.

Figure 6:
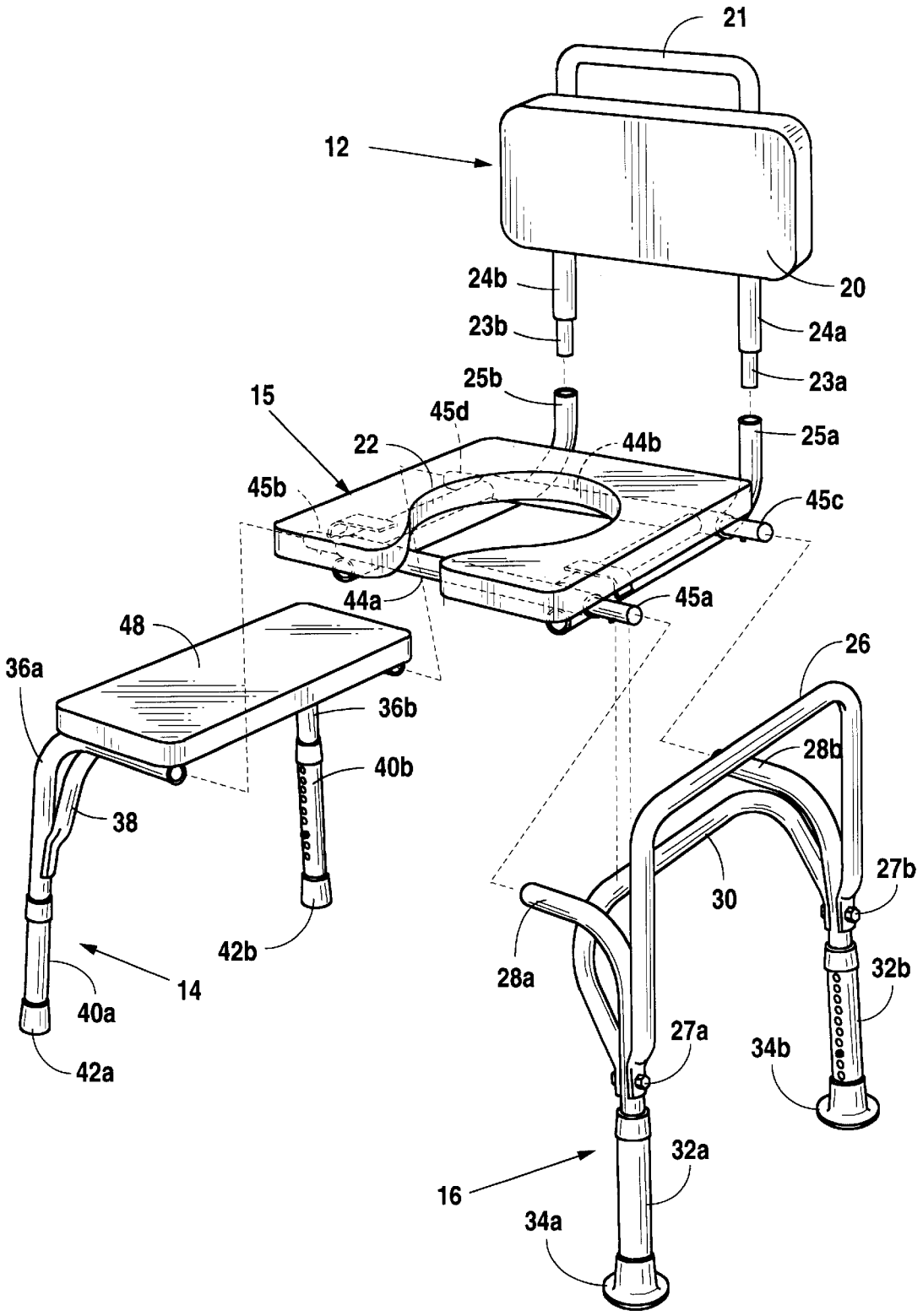
FIG. 6 is an exploded perspective view of an alternative embodiment of the transfer chair of the present invention.

In an alternative embodiment of the present invention shown in FIG. 6., cross frame section (44*a*) is permanently positioned on and attached to chair seat section (15), which eliminates the need for attachment mechanisms (27*a*) and (27*b*) (not shown in FIG. 6 but shown in FIG. 2). Likewise, cross frame section (44*b*) is permanently positioned beneath seat cushion (22) on top of seat supports (25*a*) and (25*b*). In this manner, assembly of the transfer chair involves the positioning of attachment mechanisms (45*a*) through (45*c*) as appropriate, within inside and outside leg sections (14) and (16). In this alternative preferred embodiment, no additional height or depth is added to any one component of the transfer chair and the number of loose components when the chair is disassembled is reduced to four.

The critical effort involved in breaking down the transfer chair into the number of components shown and thus permitting the smaller and more compact collapsing of the device, is maintenance of the structural rigidity associated with the non-collapsible structures of the prior art. This structural rigidity is maintained through the use of attachment mechanisms that in some cases provide a stronger frame support at a connection joint than the original continuous frame structures associated with the prior art. In other words, the attachment mechanisms described in the present invention provide a tubular structure that is stronger in most instances than an empty section of tubular frame that is continuous.

The present invention, therefore, provides improvements to the prior art structures that permit the easy disassembly of the structure into components that can be collapsed and contained within a standard suitcase type enclosures for the purpose of transport or storage. The present invention achieves this collapsibility and compactness without sacrificing the structural integrity of the assembled device.

Although the present invention has been described in conjunction with the structural design of a product manufactured by Invacare, the inventive steps associated with the preferred embodiment lend themselves to use in conjunction with other such transfer chairs. Any transfer chair that incorporates an overly long support frame with a right angled chair section could be modified according to the present invention in order to permit the easy collapse of the transfer chair for the purposes of storage or transport.

I claim:

1. An improvement to a shower or bathtub transfer chair where the transfer chair includes a four-legged, longitudinal, support frame structure and a removable, right angled chair structure, the improved transfer chair comprising:

an inside leg frame component comprising first and second inside legs and a connecting inside leg cross-member, each of said inside legs comprising a post portion and an orthogonal extension, said extension comprising and defining a portion of an overall length of said transfer chair;

an outside leg frame component comprising first and second outside legs and a connecting outside leg cross-member, each of said outside legs comprising a post portion and an orthogonal extension, said extension comprising and defining a portion of an overall length of said transfer chair;

a first cross frame component, said first cross frame component detachably connecting said inside leg frame component with said outside leg frame component by removable insertion into and between said orthogonal extensions of said first inside and outside legs;

a second cross frame component, said second cross frame component detachably connecting said inside leg frame component with said outside leg frame component by removable insertion into and between said orthogonal extensions of said second inside and outside legs, wherein a combination of said cross frame components and said inside leg frame component and said outside leg frame component, serves as said four-legged, longitudinal, support frame structure;

a chair back member comprising a planar back support and a plurality of parallel support posts; and a chair seat member comprising a planar seat support and a plurality of parallel tubular support members, said parallel tubular support members each having a longitudinal Portion and an orthogonal extension, said chair seat member removably attachable to said chair back member at an angle generally perpendicular thereto, by removable insertion of said support posts into said orthogonal extensions of said parallel tubular support members, a combination of said chair back member and said chair seat member removably attachable to said four-legged, longitudinal, support frame structure.

* * * * *